US006091187A

United States Patent [19]

Golladay et al.

[11] Patent Number: 6,091,187

[45] Date of Patent: Jul. 18, 2000

[54] HIGH EMITTANCE ELECTRON SOURCE HAVING HIGH ILLUMINATION UNIFORMITY

[75] Inventors: Steven D. Golladay, Hopewell Junction, N.Y.; Rodney A. Kendall, Ridgefield, Conn.; Carl E. Bohnenkamp, Hopewell Junction, N.Y.

[73] Assignee: International Business Machines Corporation, Armonk, N.Y.

[21] Appl. No.: 09/057,079

[22] Filed: Apr. 8, 1998

[51] Int. Cl.[7] ..... H01J 1/02

[52] U.S. Cl. ..... 313/310; 313/237; 313/337; 315/107

[58] Field of Search ..... 313/310, 236, 313/237, 337, 346 R, 346 DC; 315/107; 219/121 EB

[56] References Cited

U.S. PATENT DOCUMENTS

| | | | |
|---|---|---|---|
| 2,715,196 | 8/1955 | Reid . | |
| 2,888,591 | 5/1959 | Schmidt et al. . | |
| 2,912,616 | 11/1959 | Marchese et al. . | |
| 3,118,081 | 1/1964 | Lange . | |
| 3,745,342 | 7/1973 | Le Poole . | |
| 3,885,194 | 5/1975 | Schumacher . | |
| 4,082,937 | 4/1978 | Istomin et al. | 219/121 EB |
| 4,084,077 | 4/1978 | Porazhinsky et al. | 219/121 EB |
| 4,268,775 | 5/1981 | Barraco et al. | 313/337 |
| 4,401,919 | 8/1983 | Weiss | 315/107 |
| 4,675,573 | 6/1987 | Miram et al. . | |

FOREIGN PATENT DOCUMENTS

| | | |
|---|---|---|
| 51-89381 | of 0000 | Japan . |
| 7-161303 | 6/1995 | Japan . |
| 192961 | 4/1967 | Russian Federation . |

OTHER PUBLICATIONS

Manfred Essig & H.C. Pfeiffer, Critical Koehler Illumation for Shaped Beam Lithography, IBM Corporation, Jul. 1, 1985, pp. 83–85.

A.H.W. Beck, High–Current–Density Termionic Emitters: A Survey; The Institution of Electrical Engineers; Paper No. 2750R; Nov., 1958, pp. 372–390.

*Primary Examiner*—Michael H. Day
*Assistant Examiner*—Matthew J. Gerike
*Attorney, Agent, or Firm*—Whitham, Curtis & Whitham; H. Daniel Schnurmann

[57] ABSTRACT

Direct and indirect electron bombardment provide a sufficiently high degree of temperature uniformity across the emitting surface of a large-area electron source for an electron beam projection system such that a broad beam having illumination uniformity within 1% can be achieved. A diode gun is used to obtain extraction field uniformity and maintain uniformity of illumination. Power requirements and power dissipation in beam periphery truncating apertures is reduced by roughening the surface of a monocrystalline cathode or depositing materials having a higher work function thereon.

17 Claims, 5 Drawing Sheets

FIG.1
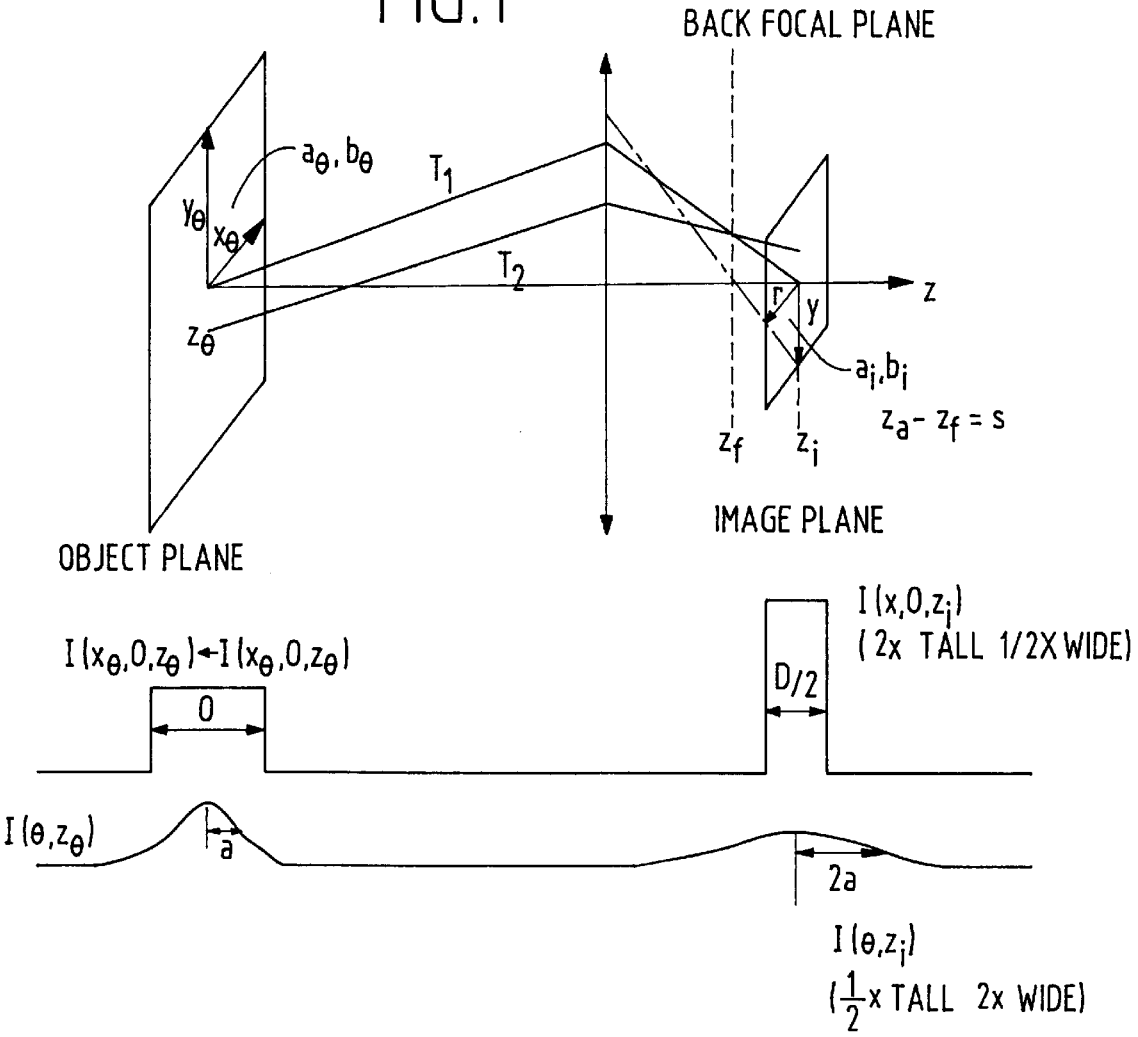
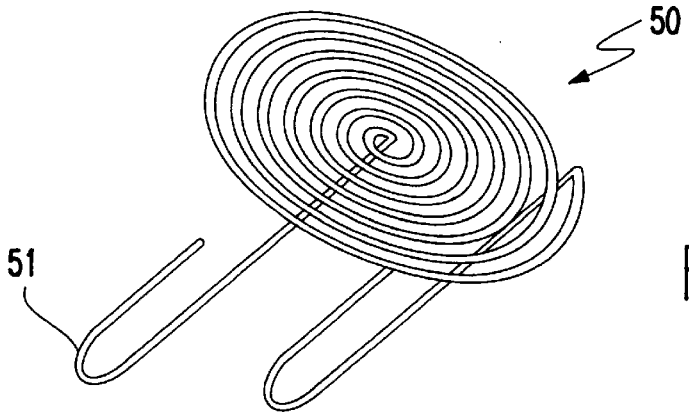
FIG.5

PRISTINE VERSION

HIGH EMITTANCE ELECTRON SOURCE HAVING HIGH ILLUMINATION UNIFORMITY

BACKGROUND OF THE INVENTION

1. Field of the Invention

The present invention generally relates to the production of high current electron beams and, more particularly, to the production of electron beams of uniform intensity over a large area and a large beam divergence angle particularly applicable to electron beam projection systems and lithography tools.

2. Description of the Prior Art

Numerous industries, especially semiconductor integrated circuit manufacturing, rely on lithographic processes in which a pattern of material is deposited or removed such as etching a pattern into a substrate or a blanket layer of material. Lithographic processes are also used to make masks which may then be used in other lithographic processes. Generally, a layer of resist is applied to a surface and a selective exposure made of areas of the resist layer. The resist is then developed to form a mask by removing either exposed or unexposed areas of the resist (depending on whether the resist is a positive or negative resist) and a material deposited or removed such as by etching, implantation, chemical vapor deposition (CVD) or the like, possibly using a plasma, in a pattern corresponding to the mask.

To produce very fine features (e.g. fine pitch, small feature size and the like) very high resolution is required. Resolution is limited by the wavelength of the radiation used to make the exposure as well as other physical effects presented by the exposure medium. Electron beams have been used as an alternative to radiation to produce exposures at finer resolution than can be accomplished using even very short wavelength (e.g. ultra-violet) light. Extreme ultra-violet (EUV) radiation and X-rays are being investigated but present additional problems.

Electron beam exposure is also convenient for complex patterns since an electron beam can be rapidly and accurately deflected by electrical and/or magnetic fields to serially expose selected areas of the resist such as in direct writing (known as probe-forming systems) or step-and-repeat processes using a mask for shaping the electron beam. These latter processes and apparatus for performing them are referred to as electron beam (or e-beam) projection processes and tools.

Electron beam projection systems which project a potentially complex pattern have much greater theoretical throughput than systems employing spot exposures because the former can produce a complex pattern with a single exposure (generally with a relatively large deflection step between exposures) while the latter is constrained to developing a desired pattern by deflecting the e-beam for serial exposure of all parts of each pattern exposed. At the same time and for a given sensitivity of resist, any realization of an increase in throughput requires an increase in beam current in view of the greater area exposed in e-beam projection systems.

However, some practical limitations on resolution are also characteristic of electron beams. Suitable resists for electron beam exposure require a significant electron flux (e.g. the number of electrons) for exposure. Therefore, throughput of an electron beam (hereinafter sometimes "e-beam") tool is limited by the beam current which can be developed. At the same time, the charge carried by each electron or ion causes a repulsion force between the like-charged particles (generally referred to as Coulomb interactions) which increases with proximity between particles. Accordingly, high density of electron population in the electron beam causes aberrations in the nature of blurring or defocussing in the beam image because of the interactions between the electrons. Therefore, there is a trade-off between resolution/aberrations and maximum beam current and throughput.

At the present time, there are three principal approaches to increasing the useable beam current while containing electron interaction aberrations to a significant degree. Two of these approaches effectively rely on reduction of the average beam current density. The first approach involves the projection of relatively large sub-fields to maintain throughput at lower current density and, if the sub-field is sufficiently large, increased total beam current can be employed without severe detrimental effects of high current density. Further, for reliable exposure over a pattern, the intensity of electron illumination across the subfield which is imaged must be highly uniform, generally within about 1% across the reticle. The second is to use a large numerical aperture which corresponds to a large beam semi-angle at the target (e.g. the average cross-section of the beam is large and sharply converged only shortly before the target through a large angle to the beam axis).

A third approach to the trade-off which allows increase of resolution at a given throughput is to increase beam energy (e.g. a high accelerating potential for the beam). Geometric aberrations (with the exception of chromatic aberrations) are unaffected by beam energy while the trajectory displacement (TD) aberration due to Coulomb interactions and chromatic aberrations decrease with increased beam energy. As the approaches discussed above reduce electron proximity by increasing the beam cross-sectional area at a given current, increased electron energy decreases the time required for an electron to traverse the beam length and allows less time over which the Coulomb interactions can develop electron displacements and consequent aberrations. This can also be conceptualized as a decrease in electron density in the axial direction of the beam.

Large sub-field sizes, large beam semi-angles and high beam energy put stringent demands on the electron source in an electron beam projection system. These demands can best be understood in terms of required source emittance. Emittance is a fundamental property of an electron optical system and is defined as the product of the diameter of the electron emitting portion of the cathode and the half-width of the angular distribution of the emitted electrons. Convenient units for emittance are millimeter-milliradians. Emittance is important because it is conserved throughout the e-beam apparatus in the sense that it cannot be increased within the optical system but, of course, may be reduced by apertures, diaphragms and the like which intercept the fringes or larger outer regions of the beam and thus reduce beam diameter.

Since the optical system cannot increase beam emittance, it follows that the electron source must provide the necessary emittance. Moreover, since the beam semi-angle is proportional to $(Vac)^{1/2}$, all the approaches discussed above for improving throughput of an e-beam projection system at a given resolution (namely, large sub-field size, large beam semi-angle and high beam energy) demand increased source emittance. The result is that for electron beam projection lithography, an emittance of 2–4 mm-mrad at 100 kV accelerating voltage is needed. This emittance is about one hundred times larger than that of conventional probe-forming e-beam systems.

The only known approach to obtaining such a required emittance is through the use of a cathode with an emission area of diameter one hundred times larger than a conventional triode gun cathode. Cathodes in this size range are known in other applications (e.g. electron beam welders, sources in high-energy particle accelerators and klystrons). However, uniformity of electron emission is not of importance in any of these applications. In sharp contrast, for an electron beam projection system of tool, uniformity is of primary importance.

To obtain high uniformity of emission, assuming that beam intensity uniformity is preserved by a distortion-free electron optical system, a cathode operating point having a particular cathode temperature, emission current and extraction field strength must be achieved in accordance with the chosen emission current and extraction field strength such that cathode emission is determined only by cathode temperature and cathode material work function. If so, since the cathode material and its work function can be controlled, uniformity of emission is principally a function of the uniformity of cathode temperature which can be achieved.

Direct resistance heating of the cathode is preferred for sub-millimeter cathodes such as might be found in electron microscopes. However, for larger cathodes, direct resistance heating is impractical because of the large currents which would be required. Accordingly, indirect heating by electron bombardment is traditionally used for cathodes larger than a few millimeters in diameter.

One known configuration for indirectly heated cathodes is in the form of a rod with a directly heated helical filament wound around the rod. However, heat losses to the mounting are significant and increased input power is required to compensate for that heat loss. Moreover, configuration of the bombardment arrangement is not compatible with a uniform accelerating or extraction field, nor is a cathode material having uniform electron emission used.

IBM TDB Vol. 26, No. 10A, March 1984, teaches dual stages of indirect heating of cathode structures. However, this approach is used to avoid alloying of lanthanum hexaboride of the indirectly heated cathode with the directly heated filament. Such alloying tends to weaken the filament. Accordingly, the lanthanum hexaboride cathode is surrounded with a tantalum or molybdenum heater cylinder having its interior coated with lanthanum hexaboride to protect the filament. No provisions or adaptations are disclosed therein directed to developing a large area cathode or high uniformity of the temperature of the cathode.

Accordingly, it is seen that the current level of skill in the art does not answer a need for a high current cathode having a large area to support high emittance while maintaining uniformity of temperature and electron emission over the large cathode area.

SUMMARY OF THE INVENTION

It is therefore an object of the present invention to provide a large area, high emittance indirectly heated cathode structure.

It is another object of the invention to provide an electron beam source having increased uniformity of emission over a relatively large area.

It is a further object of the invention to provide an electron gun structure that provides a broad beam having emission uniformity within 1% across the beam cross-section.

It is yet another object of the invention to provide a directly or indirectly heated large area cathode structure which can provide a temperature uniformity within 1° C. across the cathode.

It is yet another object of the invention to provide a large area, high-emittance, indirectly heated cathode structure wherein cathode emission is controlled by modification of the cathode surface to enhance illumination efficiency.

In order to accomplish these and other objects of the invention, an electron source is provided including a cathode having a planar principal emitting surface, an anode substantially parallel to the planar emitting surface having an aperture therein, and an arrangement for heating the cathode uniformly over a relatively large area by electron and photon bombardment of a surface of the cathode opposite to the planar principal emitting surface. Both direct heating with a large area filament and indirect heating by bombardment by emission from a subcathode are provided, possibly in multiple stages.

In accordance with another aspect of the invention, a method of limiting electron emission from a selected area of a monocrystalline cathode having a planar principal emitting surface exhibiting a first work function is provided including the step of treating the selected area to increase the work function of the selected area. Limitation of electron emission from areas which would produce portions of an electron beam requiring significant truncation reduces power input and power dissipation requirements.

BRIEF DESCRIPTION OF THE DRAWINGS

The foregoing and other objects, aspects and advantages will be better understood from the following detailed description of a preferred embodiment of the invention with reference to the drawings, in which:

FIG. 1 is a schematic diagram of a light-optical or electron-optical lens system useful for understanding the advantages realized by the invention and the principles thereof, FIG. 5 illustrates a preferred embodiment of a planar filament in accordance with the invention.

DETAILED DESCRIPTION OF A PREFERRED EMBODIMENT OF THE INVENTION

Figure 2:
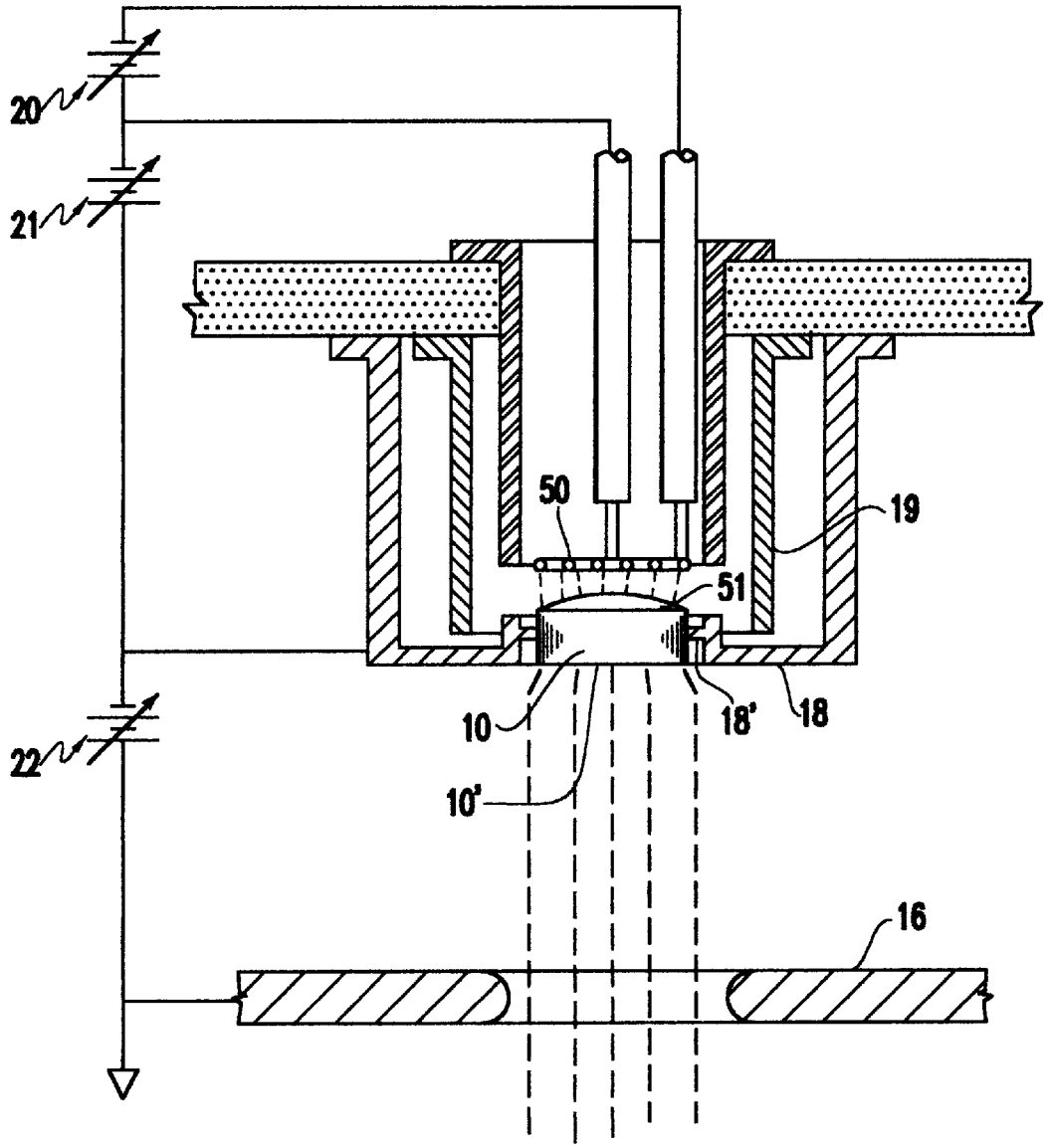
FIG. 2 and FIG. 3 are cross-sectional views of respective exemplary preferred embodiments of the invention.

Referring now to the drawings, and more particularly to FIG. 1, a light-optical or electron-optical lens system is schematically shown. The lens images the spatial intensity distribution in an object plane $I(x, y, z_0)$ to a corresponding spatial intensity distribution in the image plane I(x, y, zi). Object and image planes are said to be conjugate, as are corresponding object and image points, (ao, bo) and (ai, bi). The ratio of an object's length, lo, to the length of its image, li, is the linear magnification factor, Ml. For the illustration of FIG. 1, an linear magnification value of ½ is arbitrarily chosen.

Associated with each point in the object plane is an angular intensity distribution $I(\theta x, \theta y, z_0)$. This distribution describes how the emission from a given point varies with the emission angle. In the same manner as for spatial distributions, described above, there is a relationship between the angular intensity distribution at an object point and its conjugate point. The distributions are related by the angular magnification factor Ma. For the general case of the object and image space having different indices of refraction, no, ni, respectively, the angular magnification is given by Ma=no/(ni*Ml) or Ml*Ma=no/ni.

For the special case of the same index of refraction in both object and image space, no=ni, if an object is magnified linearly, its angular magnification is demagnified by the same factor. More generally, if the width of the angular distribution is characterized by a parameter a, then an object of size lo and its image conform to the relationship lo*αo=li*αi*ni/no. Because this product is conserved by lenses, it is of fundamental importance in optical systems and is referred to as emittance. In many optical systems, the index of refraction is the same in the object and image planes. For the electron-optical case, and, in particular, the case of an electron gun, the case is very different. The electron-optical equivalent of the index of refraction is proportional to particle velocity which is, in turn, proportional to the square root of the electrostatic potential V. For an electron gun which accelerates the electrons from an initial thermal velocity corresponding to an energy of order 0.2 eV to a final velocity corresponding to an energy of, for example 100 KeV, the factor ni/no is approximately 700. The inherent cathode emittance is reduced by approximately a factor of 700 by the gun and then conserved (except for the effects of apertures) by the rest of the optical system if the beam velocity is constant. Emittance can be reduced at apertures which block margins of the beam intensity distribution but, if no=ni, it cannot be increased. Therefore the source in an optical system must provide all the emittance required at the image plane, taking apertures into account.

At the focal plane of the lens in FIG. 1, rays which are parallel in object space (regardless of location or angle, as shown) intersect each other in the lens back focal plane. All other sets of parallel rays in image or object space also intersect in the back focal plane of the lens, respectively, as well. Of course, the same is true for parallel rays in image space intersecting at the front focal plane of the lens. The result is that the angular intensity distribution at the object plane becomes (with a scale factor) a spatial intensity distribution at the back focal plane and vice-versa.

This relationship between angular and spatial intensity distributions is exploited in illumination systems to shape illumination intensity distributions. The triode gun configuration, itself well-understood in the art, is an example of such an illumination system exploiting this relationship. The triode gun comprises a cathode, a grid and an anode. Typically, the anode is grounded and the cathode is biased to a high negative potential. The grid electrode is negative with respect to the cathode to control the electron accelerating field at the cathode and is typically adjusted so that cathode emission is confined to a small portion of the cathode surface. The emitted beam is focussed to a crossover in the gun. The grid and anode have central holes to allow the passage of emitted electrons.

The cathode and grid comprise a lens. The gun crossover is at the focal plane of the lens and the distribution of intensity at the cross-over position is typically Gaussian ($Ir=(e^{-r/ro})^2$) because the angular intensity distribution at the cathode is Gaussian. Moreover, the Gaussian distribution can be magnified such that the central portion of the Gaussian distribution, to which the beam may be truncated by an aperture, is of sufficient uniformity to illuminate the reticle or mask for projection of an image. Most of the emitted current is thus lost in the truncation process. For example, it is a well-known property of Gaussian distributions in two dimensions and truncated by a round aperture that the variation in uniformity over the aperture will equal the transmission efficiency. Thus, for a 1% variation in uniformity mentioned above, a 1% illumination efficiency will result when a beam having a Gaussian intensity distribution is sufficiently restricted to so limit intensity variation. Thus it is clear that obtaining beam uniformity by truncation of a Gaussian distribution is inherently inefficient in that only a small fraction of the emitted current (e.g. about 1%) is transmitted to the reticle.

An alternative approach to obtaining beam uniformity is known from the literature (e.g. M. Essig and H. Pfeiffer "Critical-Koehler illumination for shaped beam lithography" J. Vac. Sci. Technol. B4(1), January/February 1986) and referred to as a Critical-Koehler mode of operation wherein the cathode emission surface rather than the gun crossover is imaged. If the cathode surface emission is sufficiently uniform and if this uniformity is maintained by the imaging optics, a significantly larger fraction of the emitted current can be utilized.

The conventional triode gun is ill-suited to the Critical-Koehler mode of operation. The triode gun produces an accelerating field in the vicinity of the cathode which is weak and very non-uniform. These field characteristics result in space charge effects and imaging distortion which result in non-uniformities in the cathode image intensity even if the cathode itself is capable of uniform emission.

Accordingly, the gun configuration in accordance with the present invention is arranged for compatibility with the Critical-Koehler mode of operation or a variation thereof. Specifically, a gun configuration is adopted which produces a relatively strong and uniform accelerating field in the vicinity of the cathode. A preferred approach to obtaining the desired fields is a planar diode gun structure wherein a uniform field is generated between a planar cathode emissive surface and a planar anode. Under these uniform field conditions, cathode emission current density depends only on cathode temperature and the work function of the cathode surface and the image distortion caused by the accelerating field is negligible.

A disadvantage of the Critical-Koehler mode of operation approach as described in the prior art is its sensitivity to cathode surface imperfections. However, the inventors have found that the sensitivity to small-scale imperfections can be reduced dramatically by adjusting the imaging optics so that the cathode surface is over-focussed at (e.g. slightly above or upstream of) the reticle. However, the cathode size must be chosen large enough to accommodate the over-focussing without loss of intensity at the edges of the image. Moreover, careful attention to cathode temperature is necessary. To obtain emission uniformity of 1% the cathode temperature must be uniform to less than 1° K. at the operating temperature of approximately 2000° K. Cathode electrostatic potential must also be uniform to less than 1 volt.

Figure 3:
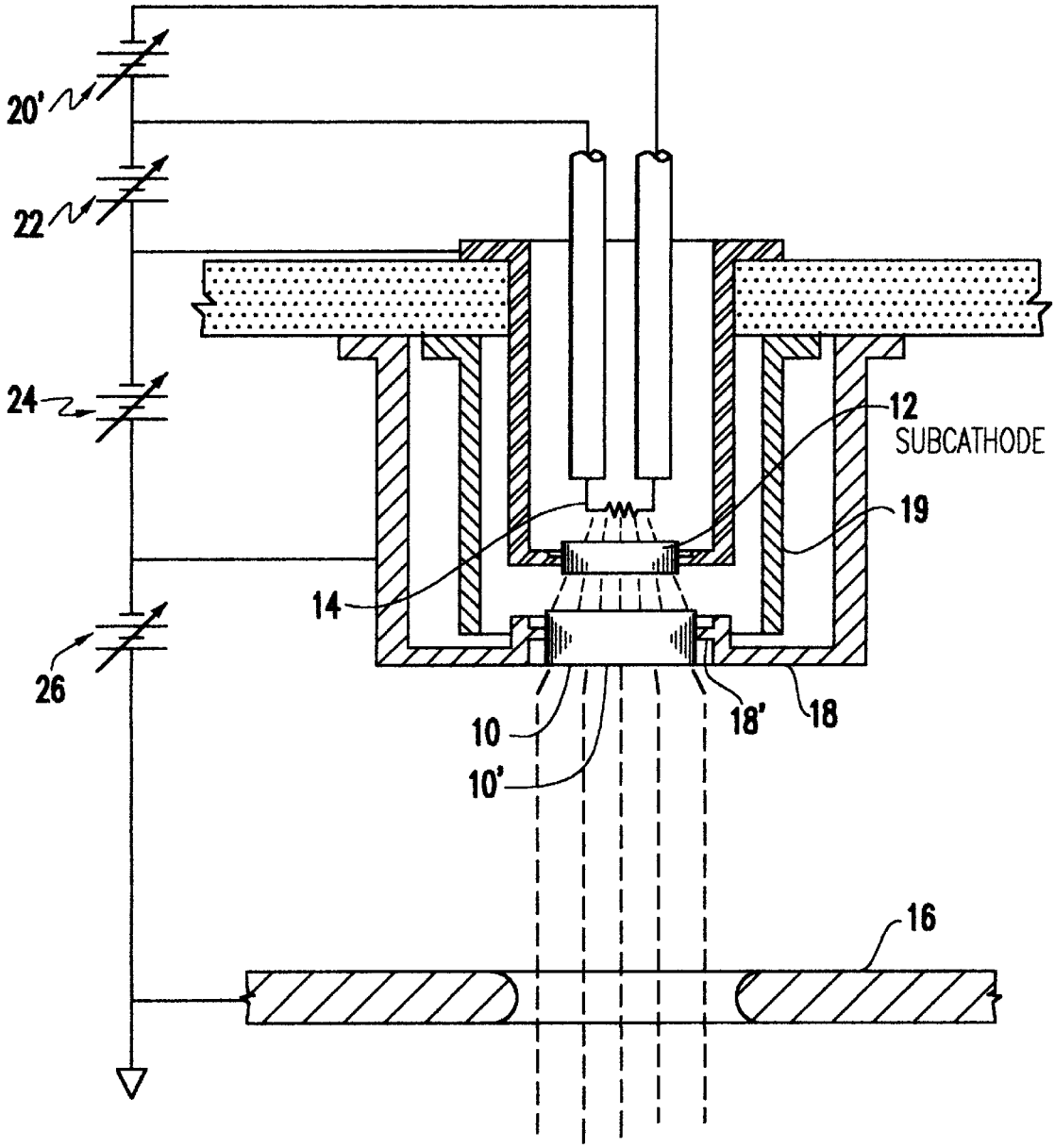

With the foregoing as basic background for understanding the function of the invention, the basic elements of the indirectly heated, large area cathode in accordance with two preferred embodiments of the invention, shown in FIGS. 2 and 3 will now be discussed. It is to be understood that this illustration is arranged to facilitate an understanding of the basic principles of the invention and is not intended to convey any particular structural organization or constraints beyond those discussed below. By the same token, it is to be understood that the preferred embodiments shown in FIGS. 2 and 3 are exemplary and provide certain relative advantages, from which other variations of the basic invention and application of the principles thereof will be evident to those skilled in the art within the scope of the present invention. The preferred embodiments shown in FIGS. 2 and 3 differ with respect to how the cathode is heated. The preferred embodiments are otherwise very similar and aspects of the invention common to the two embodiments will be discussed first.

Referring now to both FIGS. 2 and 3, the cathode provided by the invention comprises a cathode 10 having a principal emitting surface 10' preferably in the shape of a circular disk. The intrinsic electron emission properties of cathode 10 must be uniform over the principal emitting surface 10' and the thermal and electrical conductivity must be high to limit temperature and potential voltage variations across the cathode surface. For these reasons, monocrystalline tantalum, tungsten or molybdenum is preferred for cathode 10. In particular, the thermionic work function varies with crystal orientation, effectively requiring monocrystalline cathode materials. Single crystals of tantalum in the <111> orientation (±0.50) are commercially available and satisfactory for the cathode in accordance with the invention. The low work function of the <111> tantalum orientation is useful in reducing the cathode temperature required to obtain the desired emission current.

Other orientations of tantalum or tungsten or other refractory materials could be used in the practice of the invention but at the cost of increased cathode temperature, increased power consumption and other engineering complications including but not limited to material properties and maintaining temperature uniformity at increased temperatures. For example, lanthanum hexaboride ($LaB_6$), which has a low work function, is considered to be a poor choice for the cathode since its surface is unstable at the necessary operating temperatures.

Planarity of the emitting surface is important for two reasons. Most importantly, the only surfaces within a crystal with uniform electron emission properties are planar surfaces. Secondarily, the planar cathode surface is conducive to a simple approach to providing a uniform and distortion-free accelerating field for the emitted electrons, namely the planar diode gun configuration alluded to above. The portion of the cathode mounting structure 18 adjacent the anode is also planar and co-planar with the cathode emitting surface 10'. The anode 16 is also planar except for the central hole required for the passage of electrons. Because of this configuration which closely approximates a planar diode, a very uniform accelerating field is created between the cathode and anode and, as a result, the cathode can be imaged without distortion by appropriately designed lenses downstream of the anode. Cathode beam distortion, as discussed above, must be avoided to maintain uniform beam intensity.

Because the cathode and gun of the present invention are designed for use in an electron beam projection system (EBPS) which projects a square shaped illumination beam onto a reticle and because, with the Critical-Koehler illumination approach adopted, the cathode emitting surface is conjugate or nearly conjugate to the reticle, it is advantageous to limit cathode emission from areas that will not be imaged to the reticle. The option of a cathode which is physically larger than the minimum necessary, but with reduced emission from areas which will not be imaged to the reticle is preferred over a physically smaller cathode because the required temperature uniformity is more easily achieved in the central portion of a larger cathode. For example, cathode emission can be limited to a central square area in a cylindrical cathode without affecting temperature uniformity whereas physically shaping the cathode to have a square cross-section would degrade temperature uniformity because of additional heat loss from the corners of the square.

The shaping or patterning of the emission area of the cathode can be accomplished in either of two methods in accordance with the invention and which have been experimentally verified by the inventors. The first method is by deposition of a material having a higher work function than the tantalum substrate. The deposited material must also be stable at the cathode operating point of approximately 2000° K. Carbon, tungsten and rhenium are possible choices since they are the only elements with a melting point higher than tantalum. Among these materials, tungsten can be deposited on the tantalum <111> substrate by evaporation. FIG. 4 illustrates the results and the experimental results.

Figure 4A:
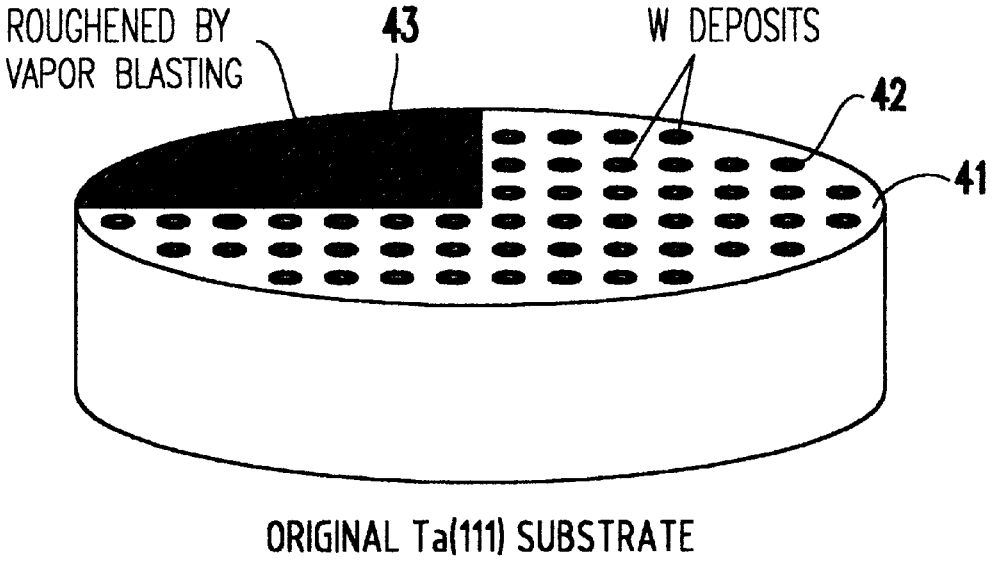
FIG. 4*a* illustrates patterning or delineation of cathode emission intensity by deposition of material and/or roughening the cathode surface in accordance with the invention.
Figure 4C:
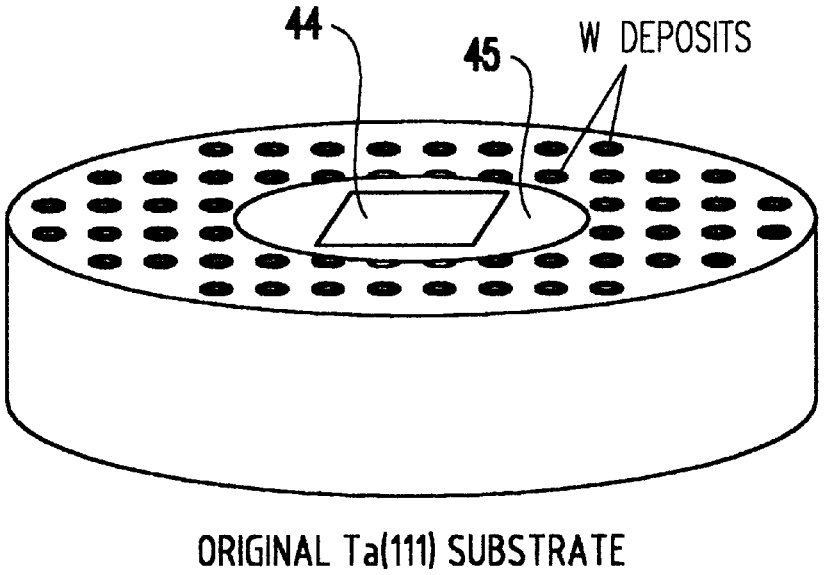
FIG. 4*c* shows a preferred patterning of tungsten deposited on a tantalum cathode to enhance illumination efficiency in accordance with the invention.
Figure 4B:
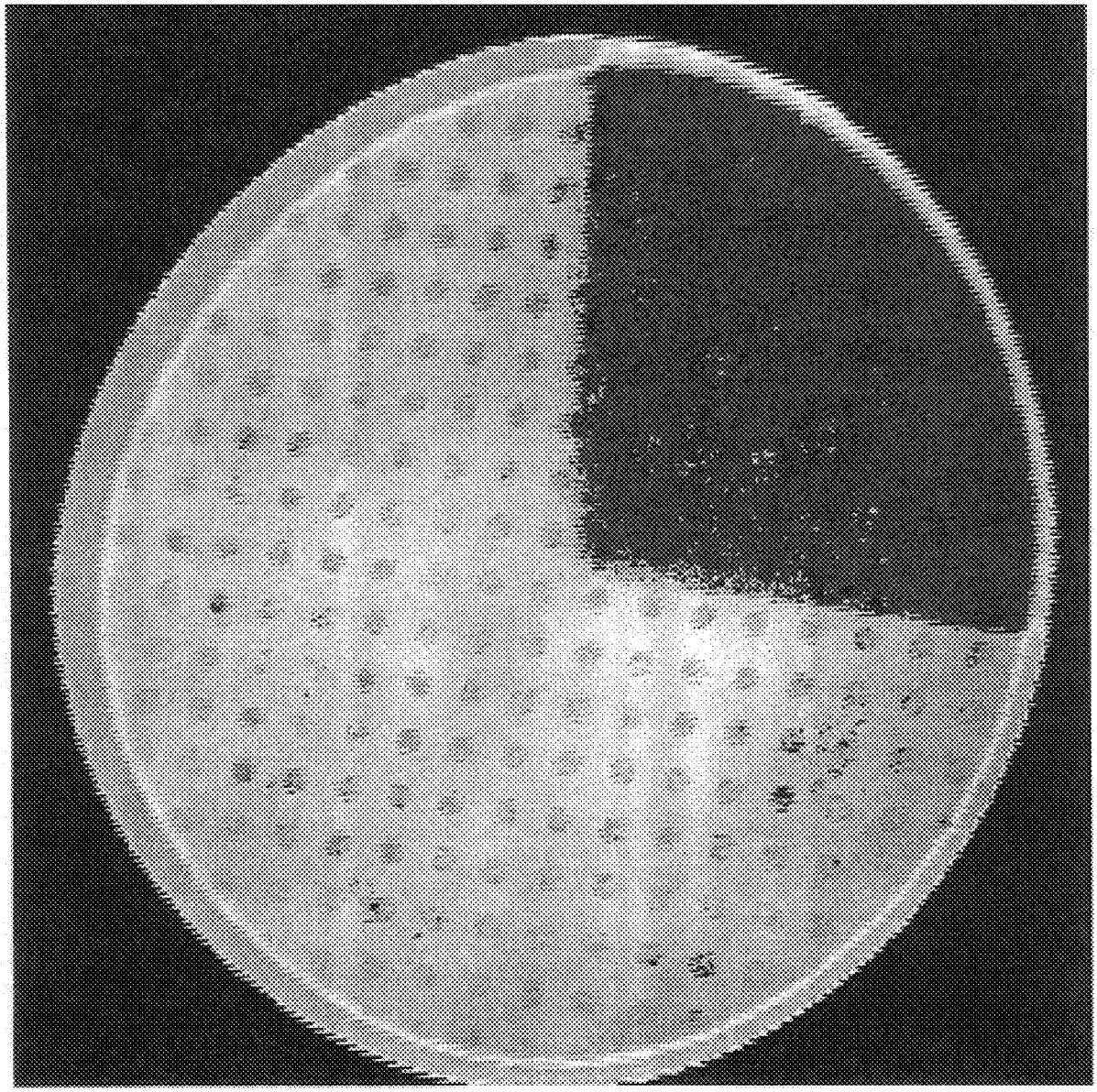
FIG. 4*b* is an image of the cathode of FIG. 4*a* wherein intensity (lightness) corresponds to electron emission current density.

Specifically, for the experimental verification of the process illustrated in FIGS. 4*a*–4*c*, the tantalum surface was masked and the evaporated tungsten deposited in a pattern of small dots 42 on tantalum substrate 41, as shown in FIG. 4*a*. The image shown in FIG. 4*b* represents the actual resulting current density in that intensity of the image (lightness) corresponds to current density (i.e. image density in FIG. 4*b* corresponds to the inverse of current density). Because of the higher work function of tungsten, electron emission is reduced from the tungsten-covered islands or dots yielding darker dots in the image of the cathode. The experiment also demonstrates that the tungsten deposits remain stable and well-localized at the cathode operating temperature and that there is no significant "poisoning" of the exposed tantalum emission surface or reduction of emission therefrom.

A second method of locally reducing cathode emission is also shown in FIGS. 4*a*–4*c* and involves roughening the planar surface of the <111> tantalum substrate. For purposes of experimental verification and as illustrated in FIG. 4*a*, one quadrant 43 of the cylindrical monocrystalline tantalum substrate 41 is roughened by vapor blasting. This roughening exposes tantalum surfaces which have a higher work function than the <111> surface and electron emission from the roughened area is correspondingly reduced. The darkened quadrant of FIG. 4*b* shows a reduction of current density comparable to that of the tungsten dots.

With either of the two approaches described above, emission from peripheral areas of the cathode surface can be selectively reduced, thereby reducing the current required from the cathode power supply and the power dissipation at the apertures in the illumination optics. In practice, of course, the cathode would be processed/patterned (e.g. by roughening or a deposited film of material which may be further patterned into lines or dots, as may be desired) so that emission is confined primarily to a central area 44, 45, the shape (e.g. 44) of which is chosen to correspond to the illumination field with some excess (e.g. 45) to permit further trimming at a shaping aperture in the illumination optical system.

Nevertheless, it should be appreciated that excess cathode current beyond that required for the illumination field and the power dissipation of the trimming aperture can be limited as desired by limitation of the area of region 45 beyond the area of region 44 which corresponds to the desired illumination field.

Cathode 10 is heated by electron and photon bombardment on the surface opposite the emitting plane in both of the respective embodiments of FIGS. 2 and 3. However, the electron and photon bombardment of the cathode is achieved in different ways in these respective embodiments. In the embodiment of FIG. 2, bombardment electrons are provided directly from a filament, preferably in the form of a spiral to extend over a relatively large area of the cathode. In the embodiment of FIG. 3, an additional structure referred to as a subcathode is interposed between a simple filament and the bombardment face of the cathode.

Regardless of the details of the bombardment approach, a uniform temperature distribution across the principal emitting surface of the cathode must be achieved. To achieve sufficient temperature uniformity, conductive and radiative heat losses from the cathode, the distribution of input heat on the bombardment face of the cathode and heat conduction through the cathode must all be considered in the detail design of the cathode and the structure by which it is supported.

Conductive heat loss from the cathode to the cathode mounting structure must be minimized as fully as possible consistent with provision of sufficient structural rigidity and dimensional stability at elevated temperatures of about 2000° K. The preferred mounting arrangement illustrated in FIGS. 2 and 3 which utilizes spot welding with minimal contact area and mounting structure with minimal cross-section (generally depicted at 18') has proven satisfactory. The cathode mounting 18 must also contain the bombardment electrons and prevent the escape of bombardment or backscattered electrons in the presence of an accelerating field. (Such electrons would have a kinetic energy which differs from that of the electrons emitted from the principal emitting surface 10' of cathode 10 and would thus cause image blur or loss of contrast.) Radiative heat losses are adequately reduced by one or more tantalum (or other refractory metal or ceramic) radiation shields 19 formed concentrically with the cathode.

The distribution of heat input to the bombardment face of the cathode is crucial to obtaining the required temperature uniformity on the principal emitting surface of the cathode. In the first preferred embodiment of the invention illustrated in FIG. 2, bombardment electrons are supplied directly from a preferably spiral tungsten filament 50, shown in isometric view in FIG. 5, which is heated by current from a first power supply 20, supplying, for example 3.5 Amperes at 15 volts. The filament is biased negative with respect to cathode 18 by a second power supply 21 to a voltage of about 3 kV. Electron emission from the filament of about 40 to 100 mA supplies the power to heat the cathode 10.

As noted above, filament 50 is preferably in the form of a planar spiral as shown in FIG. 5. The planar spiral form is advantageous in that electron emission is easily and efficiently collected and drawn to the bombardment surface 51 of the cathode, thereby reducing heating current required for the filament and prolonging filament life. Filament wire diameter is chosen large enough to be structurally robust but not so large as to require inconveniently large heating currents. A wire of about 0.2 mm diameter has been found to be a good compromise between those conflicting requirements. The flat spiral form of filament 50 accommodates the provision of a central lead 51 which is convenient to maintain the position (e.g. coaxial) of the filament with respect to the principal emitting region of the cathode. The overall diameter of the spiral is chosen to match the overall cathode size (e.g. about 10 mm in diameter to match the transverse dimension or diagonal of principal emitting region 44 or larger, depending on the chosen size of the peripheral region 45 around the principal emitting region 44 of the cathode).

With a filament 50 of the form described above, a uniform input heat distribution is produced on the bombardment side of the cathode. The heat distribution on the cathode emission surface can be calculated tasking into account radiative heat losses. Simulations show that for a particular cathode and heat shield arrangement consisting of a cylindrical cathode with a diameter to thickness ratio of 2.2, and a planar bombardment face, a temperature uniformity of about 1° K is achieved across the emitting face within a circle of a radius equal to one-half the radius of the cylinder. This uniformity can be further enhanced by applying a generally spherical contour to the bombardment face to compensate for the natural curving of the isotherms incident to sidewall radiative losses as heat is conducted from the bombardment face to the emitting face. It should be understood, however, that the object of contouring of the bombardment face is to produce a perfectly flat isotherm exactly at the emitting face by adjustment of the bombardment face contour. Therefore a simpler or more complex contour than the spherical contour may be appropriate to optimize temperature uniformity for a particular cathode and heat shield structure and can be empirically approximated from the distribution of isotherms (measured or simulated) at the principal emitting surface when the bombardment surface is planar.

Referring now to FIG. 3, a second preferred embodiment of the invention is illustrated. The embodiment shown in FIG. 3 is, in most respects, similar to the embodiment of FIG. 2 and reference numerals used in FIG. 2 are also used in FIG. 3 for corresponding elements. The embodiment of FIG. 3 differs from the embodiment of FIG. 2 principally in the cathode heating arrangement; wherein an additional element, referred to as a subcathode 12, is heated by a conventional filament 14 and provides bombardment electrons for heating the cathode.

Specifically, filament 14 is directly heated by current supplied by a first power supply 20' supplying, for example, 3 Amperes of current at 6 volts (15 watts) and emits electrons and photons toward intermediate cathode (or subcathode) 12. Subcathode 12 is biased relative to filament 14 by a second power supply 22 to about 1 kV and supplies about 100 mA of current to support the electron emission required to heat cathode 10 (about 100 watts). Cathode 10 is biased (to about 300 volts) relative to intermediate cathode 12 (and, in turn, to about 1300 volts relative to filament 14) by a third power supply 24 which, as with intermediate cathode 12, provides about one Ampere of current (300 watts) to support electron emissions. The cathode is, in turn biased to a negative high voltage (e.g. 100 kV) by power supply 26. The anode is at ground potential.

If desired, more stages may be cascaded in the same fashion but are not deemed to be desirable or required for the preferred application of the invention. The principal benefit of such cascading is to provide a progression of transverse dimensions of the filament, sub-cathode and cathode and progressive increase of emitted electron current so that heating and electron flux may be maintained more uniform, starting with a small, directly heated filament which can be easily maintained at a substantially uniform temperature.

Further, the cascaded arrangement allows a wide range of materials to be used for the sub-cathode 12. A foil of polycrystalline tantalum or lanthanum hexaboride, $LaB_6$, (which cannot be made into a filament) having a relatively low work function is preferred for high emission efficiency. By the same token, expensive, high-emission materials need not be used for the filament 14 and a conventional, highly reliable tungsten filament can be used. Moreover, and perhaps most importantly, the sub-cathode may be shaped to be more uniformly heated by the filament and to more uniformly heat the cathode 10.

Both of the preferred embodiments of the invention easily satisfy the requirement of uniformity of cathode potential. Required electron bombardment power sufficient to heat the cathode is between 100 and 200 Watts. For the directly bombarded cathode of the embodiment of FIG. 2, the power level is achieved with a potential difference of about 3 kV and a bombardment current of about 50 mA. For the cascaded bombardment embodiment of FIG. 3, this power level is achieved with a potential of about 300 volts and a current of about 500 mA. Since the specific resistance of the preferred cathode materials are in the micro-Ohm/cm range, the maximum potential difference across the cathode due to electron bombardment current flow is on the order of $10^{-6}$ volts which is negligible.

In view of the foregoing, it is seen that the invention provides a high-emittance cathode particularly suited for use in an electron beam projection system or lithography tool. The cathode is large enough relative to the size of the illuminated field that demagnification to sub-field size magnifies the emission angle to the required beam divergence. Because the cathode is heated and structured to emit uniformly, because the diode gun preserves emission uniformity, and because the cathode is approximately but not necessarily exactly conjugate to the subfield, emission from most of the cathode can be utilized for formation of the beam while avoiding inhomogeneities due to small cathode surface irregularities.

While the invention has been described in terms of a single preferred embodiment, those skilled in the art will recognize that the invention can be practiced with modification within the spirit and scope of the appended claims.

What is claimed is:

1. An electron source having high illumination uniformity including a monocrystalline cathode having a planar principal emitting surface, an anode substantially parallel to said planar emitting surface having an aperture therein, and means for heating said cathode by electron and photon bombardment of a surface of said cathode opposite to said planar principal emitting surface.

2. An electron source as recited in claim 1, wherein said means for heating comprises a filament positioned adjacent an area of said surface opposite to said planar principal emitting surface of said cathode and dimension in accordance with said planar principal emitting surface of said cathode.

3. An electron source as recited in claim 2, wherein said surface of said cathode opposite to said principal emitting surface is contoured.

4. An electron source as recited in claim 3, wherein said surface of said cathode opposite to said principal emitting surface has a generally spherical contour.

5. An electron source as recited in claim 1, wherein said means for heating comprises a filament, and a subcathode positioned between said filament and said surface opposite to said planar principal emitting surface of said cathode.

6. An electron source as recited in claim 5, wherein said subcathode is formed of lanthanum hexaboride.

7. An electron source as recited in claim 1, wherein said planar principal emitting surface of said cathode further includes means for altering work function of a selected region of said planar principal emitting surface.

8. An electron source as recited in claim 7, wherein said means for limiting electron emission comprises a deposit of material having a higher work function than a material of said cathode.

9. An electron source as recited in claim 7, wherein said means for limiting electron emission comprises a roughened portion of said planar principal emitting surface.

10. An electron source as recited in claim 1, further including means for supporting said cathode having a surface coplanar with said planar principal emitting surface and a lateral portion for confining electrons between said means for heating said cathode and said surface opposite said planar principal emitting surface.

11. An electron source as recited in claim 1, wherein said cathode is formed of monocrystalline tantalum.

12. An electron source as recited in claim 1, wherein said monocrystalline cathode is a monocrystalline refractory material.

13. An electron source as recited in claim 1, wherein said monocrystalline cathode has a uniform crystallographic orientation having a low work function at said planar principal emitting surface.

14. An electron source as recited in claim 13, wherein said crystallographic orientation is substantially <111>.

15. A method of limiting electron emission from a selected area of a monocrystalline cathode having a planar principal emitting surface exhibiting a first work function including the step of treating said selected area to increase the work function of said selected area to a second work function greater than said first work function.

16. A method as recited in claim 15, wherein said step of treating said selected area comprises depositing a material having a second work function greater than said first work function on said principal emitting surface.

17. A method as recited in claim 15, wherein said step of treating said selected area comprises roughening said principal emitting surface to expose a surface having a work function greater than said first work function.

* * * * *